US005529735A

United States Patent [19]

Durham

[11] Patent Number: 5,529,735

[45] Date of Patent: Jun. 25, 1996

[54] CUTTING OF HOLLOW CORE SLABS

[75] Inventor: John A. D. B. Durham, London, United Kingdom

[73] Assignee: Hollow Core Systems (Mid-East) Limited, London, United Kingdom

[21] Appl. No.: 281,928

[22] Filed: Jul. 28, 1994

[30] Foreign Application Priority Data

Aug. 5, 1993 [GB] United Kingdom ..... 9316211

[51] Int. Cl.[6] ..... B28B 1/00

[52] U.S. Cl. ..... 264/154; 264/157

[58] Field of Search ..... 264/157, 154, 264/150, 149, 148, 163

[56] References Cited

U.S. PATENT DOCUMENTS

| | | | |
|---|---|---|---|
| 1,416,691 | 5/1922 | Crozier | 264/154 X |
| 4,778,371 | 10/1988 | Seppänen | 264/154 X |
| 5,035,100 | 7/1991 | Sachs | 264/157 X |
| 5,366,676 | 11/1994 | Kobayashi | 264/157 X |

FOREIGN PATENT DOCUMENTS

| | | | |
|---|---|---|---|
| 0293178 | 11/1988 | European Pat. Off. . | |
| 4142583 | 6/1993 | Germany | 264/154 |
| 2174639 | 11/1986 | United Kingdom . | |

*Primary Examiner*—Karen Aftergut
*Attorney, Agent, or Firm*—Harness, Dickey & Pierce

[57] ABSTRACT

A method of transversely cutting a prefabricated slab having one or more hollow longitudinal cores includes inserting a pair of expandable plugs into at least one of the one or more cores, the plugs of the or each pair being positioned in a respective core spaced apart on opposite sides of an intended cut line and post-insertion expansion of the plugs blocking the respective core; introducing settable material into a portion of the or each blocked core between its spaced apart pair of expanded plugs; and after at least partial setting of the introduced settable material, cutting the slab transversely across the intended cut line.

15 Claims, 3 Drawing Sheets

CUTTING OF HOLLOW CORE SLABS

BACKGROUND OF THE INVENTION

1. Field of the Invention

The present invention relates to the sealing and cutting of hollow slabs, for example concrete slabs, having one or more cores.

2. Description of the Prior Art

Continuous pre-stressed hollow core concrete slabs and their formation are described, for example, in document GB-A-2,256,380. Such slabs may be made in a variety of ways such as by the extrusion, sheer compaction or slip forming methods and this is typically done on pre-stressing beds of approximately 100 meters length. The substantially uniform slabs are formed to this length with hollow cores running longitudinally. Once the concrete of a continuous slab has cured, smaller individual slabs of a predetermined length are cut from the long one. The individual slabs are then transported to building sites or to wherever else they may be required and are, for example, used in forming floors of buildings.

During the cutting of a larger slab into individual slabs a mechanically operated sawing device is used and the saw blade of this device is cooled by the use of high pressure water. Large quantities of the water combine with the concrete dust from the slabs during the cutting process, and form a fine slurry which frequently enters the cores running perpendicular to the cut. The slurry dries there and remains in the bottoms of the cores of the individual slabs at a distance of up to 1.5 meters either side of the cut.

If the cores are not used at any later stage, this slurry is of no importance. On the other hand, if the cores of the individual slabs are to be utilised at a later stage, for example to transfer air to ventilate rooms, it is necessary to clean the cores thoroughly by removing all the dried slurry residue and any other debris which may have accumulated in the cores en route to their destination, during storage or during installation. Cleaning the cores can be an expensive and time consuming operation. Further, once a core has been cleaned, it is usual to block it, preferably at both ends, to prevent any further debris accumulating in it. If the use to which the cores are to be put, is, for example, transferring air, then the blocks at the ends should be air-tight. Holes will then be provided in the undersides or top surfaces of the slabs and ducted air enters and exits the cores at precisely determined locations. It should not leak haphazardly through the slab ends.

Conventionally, concrete mortar plugs are inserted into the ends of the cores in order to seal them. To ensure that the wet concrete does not go down the cores during the sealing operation and effectively block them up, a further, non-liquid stopper must be introduced beforehand into the cores. Such stoppers are usually made of hard insulation plastic, previously fabricated to the correct design size of the cores. The disadvantage of this is that in practice, in the manufactured product, the core sizes and the shapes of cores in a hollow core slab vary considerably from each other and from their theoretical sizes and shapes. Thus the stoppers may not fit because they are either the wrong shape or size, and will allow concrete to seep past them, particularly whilst the concrete is being compacted. Further, during compaction, the pressure of the flowing concrete has a tendency to force the stopper further down into the core. It can be difficult to prevent this by fixing the stoppers into the cores securely.

This method also gives no guarantee that, even with the concrete restrained against the core stopper, there is an air-tight seal at the ends of the cores. This necessitates a specific air pressure test on each core, together with a time consuming smoke test to detect leakages from the core should they occur.

These processes are hampered by the fact that the cleaning and plugging operations are generally carried out at the building site and usually once the slabs have been installed, or immediately prior to installation in their correct locations. The whole operation as described is therefore linked to the critical path of the general construction site program and because of the laborious nature of the operation, it can be extremely time consuming with the result that site work can be delayed.

SUMMARY OF THE INVENTION

An aim of the hereinafter described and illustrated method is to provide a method for sealing selected cores in hollow core slabs, which overcome at least some of the above mentioned disadvantages. A further aim is to provide a method by which individual hollow core slabs may be cut without contaminating selected cores, and to seal the cores completely making them air-tight by the time the slabs are cut.

According to one aspect of the present invention there is provided a method of transversely cutting a prefabricated slab having one or more hollow longitudinal cores across at least one intended cut line. The method comprises inserting a pair of expandable plugs into at least one of the one or more cores. The plugs of the or each pair may be positioned in a respective core spaced apart on opposite sides of an intended cut line such that post-insertion expansion of the plugs blocks their respective core. A settable material is introduced into a portion of the or each blocked core between its spaced apart pair of expanded plugs. After at least partial setting of the introduced settable material, the slab is cut transversely across the intended cut line.

An aperture or apertures may be cut into the side of the slab immediately adjacent the portion(s) of the core or cores into which the expandable plugs are to be inserted. This enables insertion of the expandable plugs into the core or cores through the aperture(s). After inserting the expandable plugs and introducing the settable material into the or each blocked core, the aperture(s) are preferably closed with the settable material and the surface of the or each closed aperture made flush with the surrounding portion(s) of the slab slide. The settable material preferably comprises concrete and/or grout.

After insertion, the expandable plugs may require expanding. This may involve filling the inserted plugs with a gas, liquid or material under pressure. The expandable plugs may be balloon members and the expandable plugs may be filled with the settable material to cause their expansion.

Alternatively, the expandable plugs may be resiliently expandable and arranged to expand of their own accord after insertion into a respective core. A release mechanism may be provided for allowing an inserted plug to expand itself. The expandable plugs may, for example, be formed of foam rubber.

A plurality of pairs of expandable plugs may be inserted into a single core of the prefabricated slab, which slab may be a concrete slab. The pairs of plugs are spaced apart and each disposed around a different intended cut line. A plurality of sealed hollow core slab sections can be cut from the prefabricated slab by cutting across the intended cut lines.

It is usual for the prefabricated slab to have a plurality of hollow longitudinal cores. In this case, each core of the slab is preferably blocked by the introduction therein of at least one pair of expandable plugs and each core sealed by the introduction therein of settable material.

According to a second aspect of the present invention there is provided a sealed hollow core slab section manufactured by a method in accordance with the above first aspect of the present invention.

BRIEF DESCRIPTION OF THE DRAWINGS

The present invention will be further described by way of non-limitative example, with reference to the accompanying drawings, in which.

DETAILED DESCRIPTION OF PREFERRED EMBODIMENTS

The sealing process according to the present invention usually takes place within the factory producing the hollow core slab but, as described later in one of the embodiments, it may occur elsewhere, such as on site.

Figure 1:
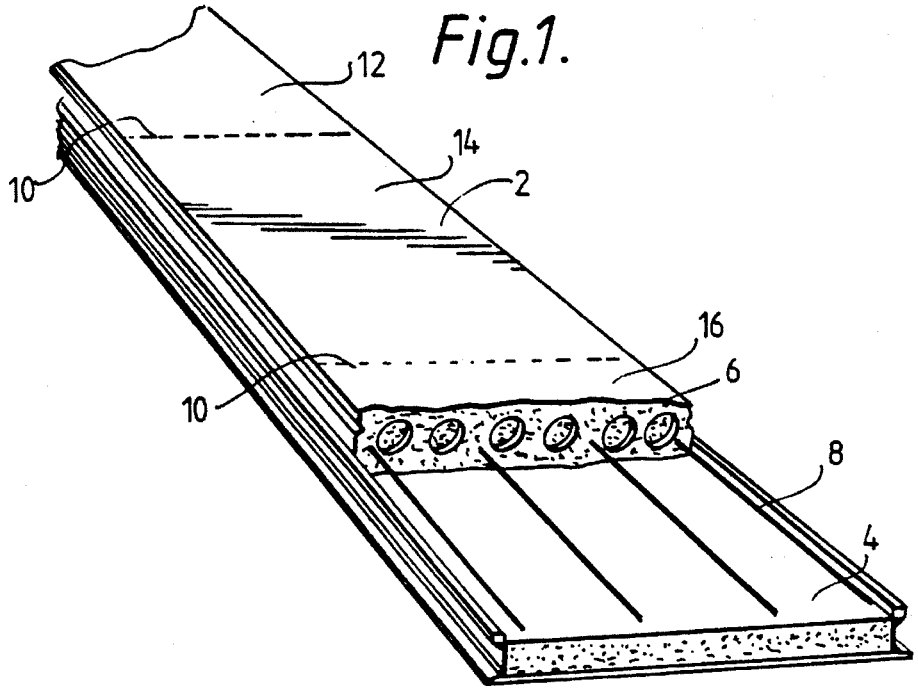
FIG. 1 shows a perspective view of a continuous hollow core slab from one end.

FIG. 1 shows a perspective view of one end of a continuous hollow core slab (2) resting atop its casting bed (4) on which it has been cast. A plurality of unconnected parallel hollow cores run along the length of the slab. These cores are formed as the slab is cast. A number of pre-stressing wires (8) or steel cables cast within the slab also run the length of the slab, though they may be omitted. Chalk markings (10) on the top of the slab and transverse to its length, divide the individual slabs (12,14) apart and indicate where it is to be cut. During cutting the near end (16) of the slab, as shown in FIG. 1, is considered to be wastage and is discarded.

Figure 2A:
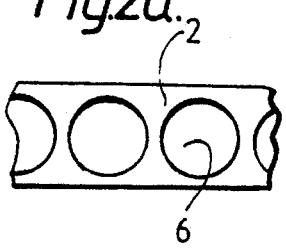
FIGS. 2*a*, 2*b*, and 2*c* show different hollow core cross-sections from hollow core slabs of different heights.
Figure 2B:
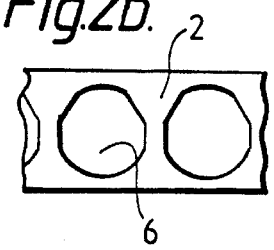
Figure 2C:
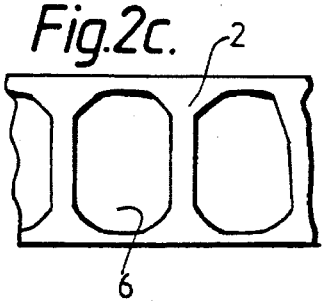

FIGS. 2*a*, 2*b*, and 2*c* show three different hollow core cross sections. It is not necessary that the core cross-sections should be circular and, as shown in these various figures they can be of non-circular shapes. They can be irregular shapes and may even differ in size and shape within the same slab. This is not always intentional.

Figure 3:
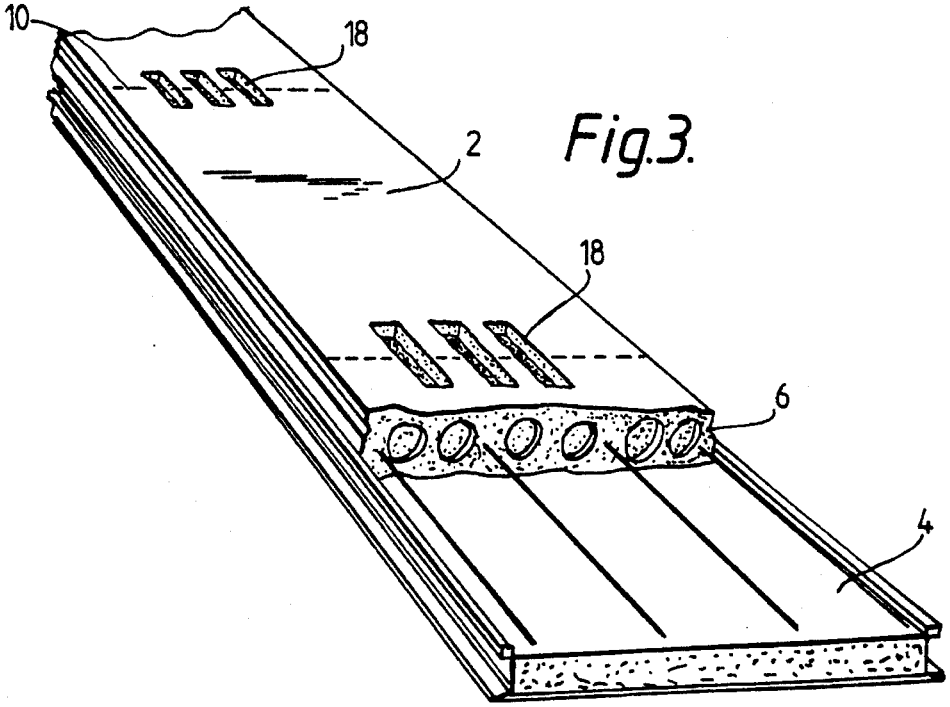
FIG. 3 shows the slab of FIG. 1 into which holes have been cut for gaining access to certain of the cores.

Once the continuous slab has been cast then, in at least the first embodiment, selected cores are to be sealed at certain points. FIG. 3 shows a view of the slab from the same perspective as FIG. 1 but with access holes (18) made in the top of the slab to gain access to the selected cores, (6) at the selected sites. These access holes (18) are made longitudinally along the cores crossing the chalk lines (10) which bisect them. The access holes are cut into the slab either manually or by machine and the concrete is removed from the top of the slab at the same time as it is cut from the surface. The holes (18) are preferably made when the concrete is still semi-wet and is still curing.

FIGS. 4*a*, 4*b*, 4*c*, and 4*d* show various stages in the process of sealing up adjacent ends of one of the cores from two adjacent individual slabs according to the first embodiment of the invention.

Figure 4A:
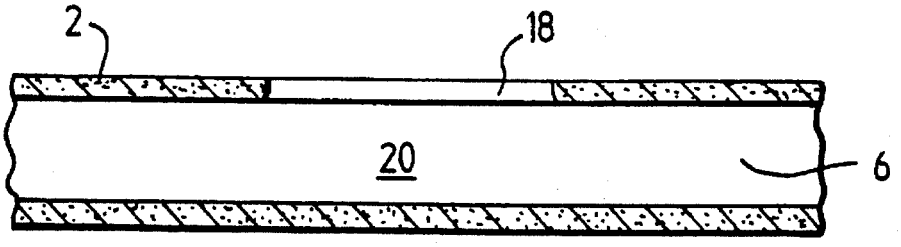
FIGS. 4*a*, 4*b*, 4*c* and 4*d* show various steps in a method of sealing cores according to a first embodiment of the present invention.

FIG. 4*a* shows the gap where the access hole (18) is cut into the top of the slab. The top surface of concrete is removed up to a distance of from 5–15 cm on each side of the location of the future saw cut, that is the chalk mark (10).

Figure 4B:
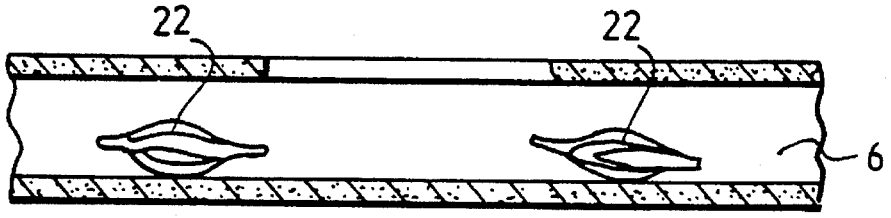

Once the cores have been breached and a desired amount of the top surface of the slab has been removed then, as shown in FIG. 4*b*, two deflated bladders or balloons (22) of an appropriate diameter are inserted into the core through the opening (18). One bladder is placed in each direction along the length of the core at a distance of approximately 10–20 cm away from the saw mark location. Thus they are placed to be surrounded by the core and not placed within the empty space (20) immediately beneath the access hole (18).

Figure 4C:
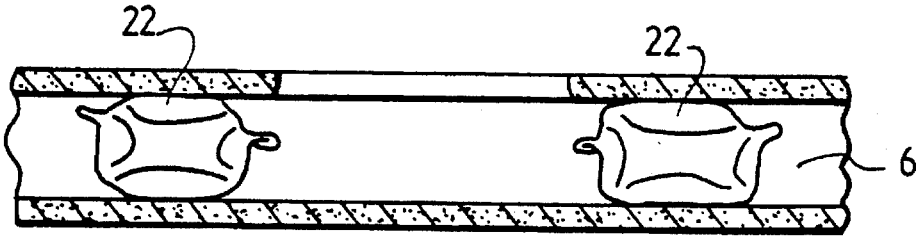

FIG. 4*c* shows the bladders (22) once they have been inflated within the core (6). In this stage the bladders are compressed against the inner surface of the core (6) in such a way as to form an air-tight seal between the core surface and the bladder. The bladders are inflated by pumping air or another gas or a liquid into them such that their surfaces compress against the inner surface of the core. The bladders are then sealed in to prevent them deflating, by, for example, a clip or some form of valve.

Figure 4D:
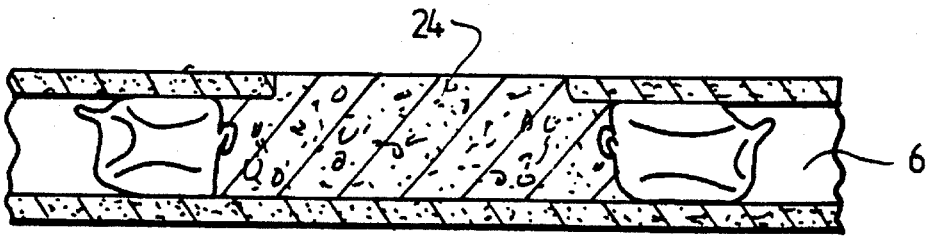

After the bladders have been inflated and sealed the empty space (20) beneath the access hole (18) is filled in. This is shown in FIG. 4*d*. The filling is a grout mix comprising the concrete previously removed from the top of the core to make the access hole, and additional concrete, preferably with a non-shrink grout additive. There are various other curing substances which can be used instead. The mix is placed into the space (20) between the two bladders (22) and, if necessary, thoroughly compacted by mechanical means. The action of filling the core with this dense concrete, or a similar medium, serves to compress the sides of the bladders further against the surfaces of the cores. The friction between the surfaces of the bladders and the inner surfaces of the core prevent the bladders from being pushed down along the length of the core by the compressed concrete. A completely air-tight seal is thus achieved by the bladders and grout mix. Finally, the top surface of the grout mix (24) is levelled off to make it flush with the top of the slab (2). The refilled access holes are then allowed to dry before the slab is cut. When the cores have been refilled they are solid in cross-section.

Figure 5:
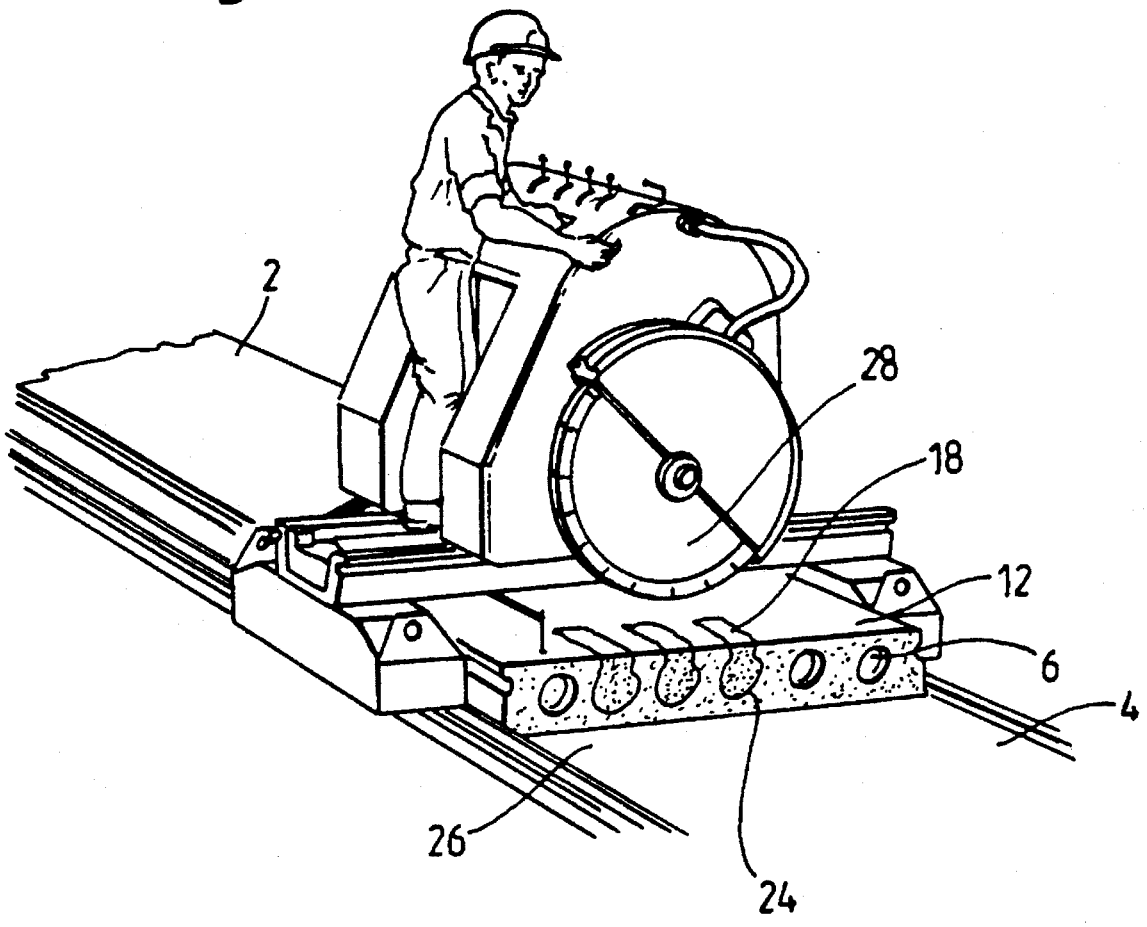
FIG. 5 shows a perspective view of an exposed end of a slab sealed according to a first embodiment of the present invention.

After the filled-in cores have cured sufficiently the continuous slab may be cut into smaller slabs. FIG. 5 shows a continuous slab which has had cores sealed in accordance with the first embodiment, and which has been cut into individual slabs. The slab piece (14) which was on the nearside of slab (12) prior to cutting along the line (10) shown in FIGS. 1 and 3 has been removed by this stage. The drawing shows that 3 of the cores are still open at their ends, whilst the others are sealed with grout mix (24) which has filled the entire volume of the core at the ends. Residue water slurry (26) from the cutting process remains on the casting bed (4).

Figure 6:
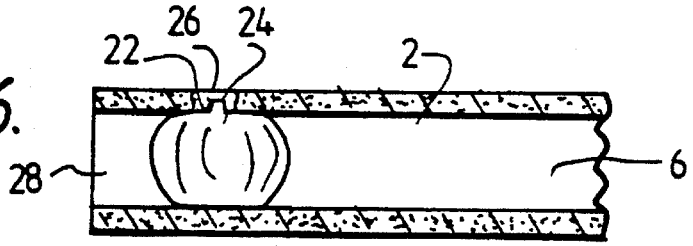
FIG. 6 shows one of the steps in a method for sealing cores according to a second embodiment of the present invention.

FIG. 6 shows a step in the second embodiment of the present invention. In this embodiment the cores may be sealed either in the factory or on site. If this occurs in the factory it may be either before or after the cutting of the continuous slab into individual slabs, and if on site it may be either before or after erection of the slabs into place.

In this embodiment a smaller access hole (26) is made into the side of a slab above a selected core and a single bladder is placed into the gap directly beneath the hole. In this instance the bladder itself is the sole plug and is filled with cement based grout or similar sealing material such that the grout expands the bladder against the wall of the core and effectively seals it. The bladder is then plugged as before and the access hole (26) filled in with cement grout (24) and levelled, again as in the previous embodiment. The filling in the bladder sets and forms an effective seal.

Using this second embodiment after the individual slabs have been cut from the larger slabs, that is at the factory or on site, the seal is usually made close to an end (28) of the slab. This form of sealing may be used at both ends. Alternatively this form of sealing may occur before the cutting of the slabs and again may be made at a location adjacent to where the slabs are to be cut or may even be made at the point where the slab is to be cut such that the set bladder is cut in two. Provided the bladder is sufficiently large and has cured sufficiently then the seal will be maintained on both sides of the cut.

In these embodiments the seal provided by a bladder itself is only meant to be temporary. A bladder is expected to fail within the lifetime of a slab, but the seal provided by the adjacent or internal concrete or grout mix is still sufficient.

Other marks than chalk marks could be used to indicate where the continuous slab is to be divided up. It is not necessary that any of these marks should run across the entire width of the slab, or even anywhere on the slab itself. Measurement for dividing up the continuous slab could instead be taken from other points relative to it.

In either embodiment any number of the cores may be selected to be sealed. Further, the same core does not need to be sealed at every cutting point along the entire length of the long slab, but may be sealed for one or more of the individual slabs. It does not matter if a sealed core is eventually used or not.

The bladders in either embodiment must be able to withstand rough handling and contact, under pressure, with the internal surface of the core, which may have sharpened protrusions. To expand them may require pressure, or they may be self expanding. In the first embodiment other suitable stoppers such as expanding foam or foam rubber could be used instead of the bladders.

In the first embodiment two bladders are only necessary where the cores to either side of a cut are to be used. If only one is to be used then a bladder is only required in the end of that core. However, a plug down the other core would be useful to ensure proper compaction of the filling grout.

The entire sealing operation in the first embodiment takes place in a factory on the casting bed where the hollow core slab has been produced, either immediately after it has been cast, or at any time during the curing period prior to the mechanical cutting of the individual slabs. Because the cores are sealed on both sides of a cut through the slab, both water and cement residue are prevented from entering those plugged cores.

Once cut the slabs are then removed and transported to the building site where they are erected. The sealed core remains sealed at all times. The bladder is left within the core, eventually losing its air and disintegrating. But, the concrete plug originally formed in the slab remains intact and air-tight indefinitely.

Whilst, in the described embodiments, concrete has had to be cut from the slab to enable access to be gained to the cores it is envisaged that continuous slabs could be produced with these holes already existent.

I claim:

1. A method of transversely cutting a prefabricated slab having upper and lower sides and one or more hollow longitudinal cores, across at least one intended cut line, the method comprising:

providing the slab with at least one aperture through one of the lower and upper sides into at least one of the one or more hollow cores, in a vicinity of the at least one intended cut line;

inserting at least one pair of expandable plugs through the at least one aperture into positions in at least one of the one or more hollow cores, the expandable plugs of the or each pair being positioned in a respective core spaced apart on opposite sides of the at least one intended cut line;

expanding the inserted plugs to block the respective core or cores;

introducing settable material through the at least one aperture into the or each blocked core between its spaced apart pair of expanded plugs to fill and seal the or each blocked core between the pair or pairs of expanded plugs; and after at least partial setting of the introduced settable material, cutting the slab transversely across the at least one intended cut line to form smaller individual slabs with at least one hollow core blocked at at least one end.

2. A method as claimed in claim 1, wherein the at least one aperture is cut into one of the upper and lower sides of the slab immediately adjacent the positions of the core or cores into which the expandable plugs are to be inserted.

3. A method as claimed in claim 2, further comprising, when introducing the settable material into the or each blocked core, closing the at least one aperture with the settable material, the or each closed aperture having an outer surface, and making the outer surface of the or each closed aperture flush with the surrounding slab side.

4. A method as claimed in claim 1, wherein the settable material comprises concrete, grout or a mixture thereof.

5. A method as claimed in claim 1, further comprising filling the inserted plugs with a gas, liquid or material under pressure to cause their expansion.

6. A method as claimed in claim 1, wherein the expandable plugs are resiliently expandable and expand of their own accord after insertion into a respective core.

7. A method as claimed in claim 1, wherein the or each expandable plug is provided with a self-expansion mechanism, and the method further comprises the step of releasing the or each self-expansion mechanism to allow the or each inserted plug to expand itself.

8. A method as claimed in claim 6, wherein the expandable plugs are formed of foam rubber.

9. A method as claimed in claim 1, wherein the expandable plugs are balloon members.

10. A method as claimed in claim 1, wherein the slab is a concrete slab.

11. A method as claimed in claim 5, wherein the inserted plugs are filled with the settable material.

12. A method as claimed in claim 1, wherein the slab has a plurality of intended cut lines, a plurality of the pairs of expandable plugs are inserted into a single core of the prefabricated slab, through a plurality of the apertures, the pairs of plugs being spaced apart and each disposed around a different intended cut line, and a plurality of sealed hollow core slab sections are cut from the prefabricated slab by cutting across the intended cut lines.

13. A method as claimed in claim 2, wherein the slab has a plurality of intended cut lines, a plurality of the pairs of expandable plugs are inserted into a single core of the prefabricated slab, through a plurality of the apertures, the pairs of plugs being spaced apart and each disposed around a different intended cut line, and a plurality of sealed hollow core slab sections are cut from the prefabricated slab by cutting across the intended cut lines.

14. A method as claimed in claim 1, wherein each of a plurality of cores of the prefabricated slab is blocked by the introduction therein of at least one pair of expandable plugs and each core is sealed by the introduction therein of the settable material.

15. A method as claimed in claim 2, wherein each of a plurality of cores of the prefabricated slab is blocked by the introduction therein of at least one pair of expandable plugs and each core is sealed by the introduction therein of the settable material.

* * * * *